United States Patent [19]

Cordova et al.

[11] Patent Number: 4,548,866

[45] Date of Patent: Oct. 22, 1985

[54] HIGH STRENGTH HOLLOW FILAMENT YARN

[75] Inventors: Colleen W. Cordova, Richmond; Brij M. Mago; Garland L. Turner, both of Chesterfield; William D. Braswell, Chester, all of Va.

[73] Assignee: Allied Corporation, Morris Township, Morris County, N.J.

[21] Appl. No.: 542,944

[22] Filed: Oct. 18, 1983

[51] Int. Cl.[4] ..... D02G 3/00

[52] U.S. Cl. ..... 428/398; 57/243; 57/248; 428/373; 428/401

[58] Field of Search ..... 428/373, 376, 398, 364, 428/401; 57/243, 248, 902

[56] References Cited

U.S. PATENT DOCUMENTS

| | | | |
|---|---|---|---|
| 2,999,296 | 9/1961 | Breen et al. . | |
| 3,160,193 | 12/1964 | Baggett et al. . | |
| 3,389,548 | 6/1968 | Lachaussee et al. . | |
| 3,465,618 | 9/1969 | McIntosh et al. | 57/248 X |
| 3,630,824 | 12/1971 | Rohlig . | |
| 3,728,428 | 4/1973 | Turner . | |
| 3,745,061 | 7/1973 | Champaneria et al. | 428/398 |
| 4,020,229 | 4/1977 | Cox, Jr. | 428/398 X |
| 4,129,675 | 12/1978 | Scott . | |
| 4,251,588 | 2/1981 | Goetemann et al. . | |
| 4,279,053 | 7/1981 | Payne et al. . | |

*Primary Examiner*—Lorraine T. Kendell

*Attorney, Agent, or Firm*—Virginia S. Andrews; William H. Thrower

[57] ABSTRACT

A yarn containing hollow synthetic polymer filaments having an outside diameter ranging from 0.02 to 0.20 mm is provided. The yarn has a filament to yarn strength translation efficiency of at least 98 percent and a yarn to cord strength translation efficiency of at least 90 percent. The yarn has utility in medical products, self-buoyant assemblies, ropes and braids, filtration fabrics, textured products, tire cord and ballistics.

14 Claims, No Drawings

HIGH STRENGTH HOLLOW FILAMENT YARN

BACKGROUND OF THE INVENTION

The present invention relates to a yarn formed of shaped hollow filaments produced from synthetic fiber-forming compositions.

The textile industry has long been interested in hollow filaments because of the special attributes of such fiber and the several novel effects which may be obtained with them. It is well recognized that hollow filaments have certain advantages over solid filaments having the same outer diameters. Some of the advantages which hollow filaments have over solid filaments include: improved installation properties, increased buoyancy, reduced pilling, special optical effects, and greater covering power per unit weight. Hollow filaments also have less tendency to fibrillate under flexing conditions than corresponding solid filaments.

In the tire industry, reinforcing cord made of hollow filaments has been found to extend the flex-life of rubber tires by imparting a tire fatigue resistance property thereto. See U.S. Pat. No. 3,160,193 to Baggett et al., hereby incorporated by reference. U.S. Pat. No. 3,389,548 to Lachaussee et al., hereby incorporated by reference, uses hollow man-made filaments in the production of cordage products suitable for use as binding twine wherein improvements in knotted strength, dynanometric characteristics and resistance to weathering and water are noted. Other patents on the use of hollow man-made filaments are U.S. Pat. Nos. 2,999,296 to Breen et al., 3,630,824 to Rohlig, 4,129,675 to Scott, 4,251,588 to Goetemann et al. and 4,279,053 to Payne et al., all of which are hereby incorporated by reference.

Yarn of the present invention exhibits very high strength translational efficiency.

SUMMARY OF THE INVENTION

The present invention provides yarn, containing a plurality of synthetic polymer filaments, each of which has a continuous void throughout its length and an outside diameter ranging from 0.02 to 0.20 mm, more preferably 0.025 to 0.15 mm. The yarn has a filament to yarn strength translation efficiency of at least 98 percent. The filament to yarn strength translation efficiency (percent) is determined by multiplying the number, resulting from dividing the breaking strength (gpd) of a single fiber by the breaking strength (gpd) of the untwisted yarn bundle, by 100. Breaking strengths are determined in accordance with ASTM D-885-1981.

The present invention also provides a yarn, as described, which has a yarn to cord strength translation efficiency of at least 90 percent. The yarn to cord strength translation efficiency is the number resulting from dividing the breaking strength (gpd) of the greige cord by the breaking strength (gpd) of the yarn end, the latter breaking strength being multiplied by the number of ends forming the greige cord, by 100.

Synthetic thermoplastic polymers suitable for use in the present invention include most of the fiber-forming melt-spinnable compositions. Those compositions which are preferred include polyesters, such as polyethylene terephthalate and polyhexahydro p-xylylene terephthalate; polyamides such as polyhexamethylene adipamide and polycaproamides; polyolefins, such as polyethylene and polypropylene, polyurethanes; polyesteramides; polyethers; and other synthetic polymers and mixtures thereof.

The yarns of the present invention have a drawn denier of 250 to 1500, preferably 850 to 1000, a tenacity of at least 6.0 gpd, preferably 6.0 to 9.5 gpd, a percent hollow of 3 to 50, preferably 3 to 30, most preferably 5 to 17. The percent hollow is determined by dividing the cross-sectional area of the void by the cross-sectional area bounded by the perimeter of the filament and multiplying by 100. The breaking strength ranges from 3.4 to 26.5 gpd, more preferably 13.9 to 17.5 gpd, and the breaking elongation ranges from 10 to 30 percent, more preferably from 14 to 20.5 percent. These values are determined in accordance with ASTM D-885-1981, hereby incorporated by reference, with the following modifications: relative humidity—65 percent, and temperature—70° F. (21° C.).

The hollow fibers of the present invention exhibit improved translation efficiency, dynamic adhesion and fatigue.

Principle applications for the yarn of this invention include tire cord, medical products, ropes and braids, self-buoyant assemblies, filtration fabrics, textured products and ballistics.

DESCRIPTION OF THE PREFERRED EMBODIMENT

Various fiber cross-sections are permissible although a filament with a circular cross-sectional area and void of square cross-sectional area are preferred. In the examples which follow the spinnerette orifice is like that shown in FIG. 3 of U.S. Pat. No. 3,772,137 to Tolliver, hereby incorporated by reference, wherein the values of A, B, and C are, respectively, 0.060 inch (0.152 cm), 0.048 inch (0.122 cm), and 0.0047 inch (0.0119 cm).

PROCESS CONDITION EFFECTS

Melt Temperature/Melt Viscosity—Within the practical process boundaries of a given polymer/spinnerette system, melt temperature can be varied to produce closure and exhibit some control over the targeted void area. A low-melt temperature may help in closure, in increasing void area, and to better produce a better defined cross-section; but one must not go so low as to effect the drawability of the product. As the melt temperature is increased the melt becomes more mobile producing some smoothing of the cross-section and reduction in void area, which in many cases is desirable. For polycaproamide (nylon 6), a temperature of from about 240° to about 290° C., preferably 255° to 275° C., is used.

Quench—The quenching medium can be utilized in conjunction with the melt temperature effect as a process control of apparent melt viscosity to control void area. In order to be effective in this respect for polyamide the quench medium must be introduced near the spinnerette face. Quench medium temperatures of 0° to 100° C. can be used, with steam as the quenching medium for the higher end of the range.

Throughput—The major effect of throughput is that increased flow has the same effect as a temperature increase. This is evidenced by a rounding of the cross-section and a decrease in void area. Therefore, quench becomes more difficult, but more necessary if the desired hollow area is to be obtained. With certain designs of spinnerettes the increased jet velocity may lead to doglegging of the melt stream as the throughput is increased. Thus at high throughput rates it is mandatory that spinnerette quality be rigidly maintained. For polyamide a throughput of 0.1 pound/hour/hole to 0.75 pound/hour/hole and preferably 0.4 to 0.6 pound/hour/hole is used.

Additive—Additives cause effects that tend to affect the melt viscosity and surface tension of the melt.

Drawing—As the amount of void area increases the amount of filament deformation increases. This is not a really serious problem at void areas less than 30 to 35 percent.

Summary of process conditions—During the spinning of hollow cross-section filaments, process conditions must be set on the basis of their rheological effect on the filament. In subsequent treatments such as drawing and texturizing possible mechanical effects must be considered.

Process conditions determined are applicable to polycaproamides (nylon 6). For other polymers, the conditions can be determined according to melt characteristics during spinning. For example, nylon 6,6 (polyhexamethylene adipamide) spinnerette temperature would range from about 280° to 310° C.

EXAMPLES 1-3

Polycaproamide was melt extruded at a rate of 32 pounds per hour (15 kg per hour) and at a temperature of 277° C., under a pressure of 2000 to 3000 psig (14 000 to 21 000 kPa), through a 136-orifice spinnerette assembly as described, and quenched with cooling air at a temperature of 75° F. (24° C.) at a rate of 100 cfm (0.05 $m^2/s$) to produce a 3600 denier undrawn yarn. See U.S. Pat. No. 3 619 452 to Harrison et al., hereby incorporated by reference. The extruded fiber was bundled to form a single yarn end which was lubricated (5 percent wet pickup) and collected at about 2100 feet per minute (10.7 m/s). The yarn was then draw wound at the draw ratios specified in Table 1 to produce yarn having the specified deniers. Throughput was 1120 ft/min (5.7 m/s) and heater temperature was 185° C. Tenacity, breaking strength and ultimate elongation are also reported in Table 1. The yarn had a relative viscosity of 85 to 90, as determined at a concentration of 11 grams of polymer in 100 ml of 90 percent formic acid at 25° C. (ASTM-D-789-62T). The percent hollow was 17. In Table 1, Example 1 data is the average of 60 tests while the Example 2 data is the average of 50 tests.

TABLE 1

| Example | Draw Ratio | Denier | U.T.S. (gpd) | B.S. (lbs) | U.E. (percent) |
|---|---|---|---|---|---|
| 1 | 4.05 | 952 | 7.42 | 15.57 | 19 |
| 2 | 3.97 | 973 | 7.15 | 15.34 | 19 |

The mechanical properties of the yarn were examined (see Table 2 for this Example 3); the yarn and its fibers were evaluated for response to a range of traditional textile manufacturing processes, including twisting, braiding and weaving. In the table, parenthetical notations are coefficients of variation, in percent. The translation from fiber properties to bundle properties is very good, with a strength translation efficiency of 99 percent. This implies good uniformity of filament properties and a high degree of simultaneity of fiber breakage in the stressed yarn; this is to some extent borne out by the low coefficient of variation of the yarn breaking strength. Note also, the fiber knot efficiency is very high (approximately 96 percent) although the loop efficiency is considerably lower (approximately 75 percent). When the yarn is twisted, the magnitude of the strength loss at the highest level of twist is very low. The yarns accepted twisting and steam setting very well. Braids were made using a 16 carrier braider with a range of picks per inch: the zero twist, unset yarn was used for these braids, which showed an average strength translational efficiency of 92 percent. The low twist (3-7 tpi) steam-set yarns were subsequently incorporated as warp yarn in a range of ten different woven fabric construction. Details of the ends and picks per inch and some mechanical properties of the fabrics are shown in Table 2. The fabrics all wove without problems. The strength translational efficiency is varied with construction, with the best being 91 percent for the 1×3 twill, a very acceptable level of efficiency for a fabric of this type. The fibers have a density less than unity, and braids and fabrics made therefrom will float in water even after prolonged immersion.

TABLE 2

Example 3

Fiber Denier: Mean Fiber Denier - 8.15 (11.8%)
Yarn Denier: Mean Yarn Denier: 970 (0%)
Numbers of Fibers in Yarn: 119
Fiber Density: 0.945 $g/cm^3$ at 23° C.

Single Fiber Properties:

Axial Break Strength (ASTM-D-3822)
Average gpd - 7.3 (6.0%)
Break Elongation Range (%) - 18.2-28.1
Loop Break Strength (ASTM-D-3217)
Average gpd - 5.5 (25.1%)
Knot Break Strength (ASTM-D-3217)
Average gpd - 7.0 (13.5%)
Effective Transverse Compressive Modulus (psi)
$0.3-0.5 \times 10^5$
Calculated Fiber Cross Section Area: $9.58 \times 10^{-6}$ $cm^2$
Calculated Fiber Outside Radius:
$1.75 \times 10^{-3}$ cm (0.035 mm)
Calculated Fiber Inside Radius: $0.80 \times 10^{-3}$ cm
Calculated Fiber Moment of Inertia: $2.35 \times 10^{-12}$ $cm^4$
Calculated Fiber Polar Moment of Inertia:
$4.70 \times 10^{-12}$ $cm^4$ Untwisted Yarn Properties:

Axial Break Strength (ASTM-D-2101)
Average gpd - 7.2 (1.9%)
Modulus (gpd) - 35.6 (8.0%)
Break Elongation (%) 17.4 (5.7%)
Loop Break Strength
Average gpd - 5.4 (7.5%)
Break Elongation Range (%) - 12.3-13.7
Knot Break Strength
Average gpd - 5.5 (5.1%)
Break Elongation Range (%) 13.0-14.2

| Twisted Yarn Properties | | | |
|---|---|---|---|
| Twist (tpi) | Break Strength (gpd) | Modulus (gpd) | Elongation (%) |
| | Control | | |
| 3.7 | 7.3 | 28.2 | 20.1 |
| 5.5 | 7.6 | 23.3 | 23.4 |
| 7.4 | 7.5 | 22.9 | 26.3 |
| 9.9 | 7.5 | 18.3 | 27.7 |
| 11.8 | 7.4 | 12.0 | 34.6 |
| | Steam Set at 70° C. | | |
| 3.7 | 7.3 | 13.7 | 26.5 |
| 5.5 | 7.3 | 17.7 | 24.2 |
| 7.4 | 7.3 | 17.1 | 25.3 |
| 9.9 | 7.5 | 13.2 | 31.5 |
| 11.8 | 7.3 | 13.5 | 30.8 |

| Fabric Properties | | | | | |
|---|---|---|---|---|---|
| Sample No. | Construction | Weave | Permeability ($ft^3$/min/$ft^2$)* | Weight (oz/$yd^2$) | Break Load (lbs/in) |
| A | 37 × 24 | plain | 4.13 | 8.7 | 478 |
| B | 37 × 24 | 2 × 2 | 47.5 | 8.2 | 485 |

TABLE 2-continued

| | | | | | |
|---|---|---|---|---|---|
| | | twill | | | |
| C | 37 × 24 | 1 × 3 twill | 93.60 | 8.4 | 525 |
| D | 37 × 24 | 1 × 3 crow ft twill | 58.30 | 8.3 | 382 |
| E | 36 × 16 | plain | 25.8 | 7.2 | 445 |
| F | 36 × 16 | 2 × 2 twill | 211.0 | 7.2 | 508 |
| G | 36 × 16 | 1 × 3 twill | 200.0 | 7.2 | 515 |
| H | 36 × 16 | 1 × 3 crow ft twill | 211.0 | 7.2 | 445 |
| I | 36 × 11 | plain | 97.0 | 6.5 | 480 |
| J | 36 × 11 | modified basket (oxford) | 88.7 | 6.5 | 420 |

*ASTM-D-737
Breaking strength on fabric ASTM-D-1682.

EXAMPLE 4

Yarn was prepared as in Examples 1–3 with an extrusion temperature of 275° C. and quench air at 120 cfm (0.06 $m^2/s$). The yarn was drawn on a drawtwister at a 4.24 draw ratio. The throughput was 1117 feet per minute (5.7 m/s) and heater temperature was 185° C. The twist per inch was 0.3Z. The target was 900 drawn denier. The physicals are presented in Table 3.

EXAMPLE 5

The procedure of Example 4 was followed with an extrusion temperature of 270° C. and a draw ratio of 4.13. The yarn was lubricated to achieve 4.5 percent wet pickup. Steam was introduced under pressure of 5 psig (34 kPa) directly below the spinnerette face to produce a yarn having approximately 5.3 percent hollow. Physicals are presented in Table 3.

TABLE 3

| Example | Denier | U.T.S. (gpd) | B.S. (lbs) | U.E. (%) | Percent Hollow |
|---|---|---|---|---|---|
| *4 | 906 | 7.92 | 15.83 | 22 | 17 |
| **5 | 911 | 7.87 | 15.77 | 22 | 5.3 |
| 6 | 894 | 8.2 | 16.2 | 17.3 | 17 |
| 7 | 845 | 9.1 | 16.9 | 15.5 | 5 |

*Average of 50 tests.
**Average of 10 tests.

EXAMPLES 6–7

The procedures of Examples 4 and 5 were followed in Examples 6 and 7, respectively, with a draw ratio set to achieve a target drawn denier of 840. The physicals on these yarns are also set forth in Table 3.

These yarns, along with the control yarn, were tested for the properties set forth in Table 4. The control yarn was set as the standard, i.e., at 100 percent (except for translational efficiency of yarn to dipped cord). The control yarn was produced like the yarns of Examples 1–3 with the following changes: The spinnerette had 136 circular orifices of 18 mil diameter; extrusion temperature 270° C; quench air temperature 70° F. (21° C.) at a rate of 110 cfm (0.5 m/s); 3450 undrawn denier; 4 percent wet pickup; draw ratio 4.4; heater temperature 180° C.; and takeup 1117 ft/min (5.7 m/s).

Reference to Table 4 shows the tremendous improvement in yarn to cord translational efficiencies achieved by the yarn of the present invention. Some data have been produced, however, which do not show this improvement.

EXAMPLE 8

Polyethylene terephthalate pellets were melted at about 285° C. and were melt extruded under pressure of about 2500 psig (17 000 kPa) through a 140-orifice spinnerette assembly and quenched with cooling air at a temperature of 75° F. (24° C.) at a rate of 110 cfm (0.05 m/s) to produce a 3900 undawn denier yarn. The extruded fiber was bundled to form a single yarn end which was lubricated (5 percent wet pickup) and collected at about 1100 feet per minute (5.6 m/s). Dimensions A, B and C of the spinnerette orifice were, respectively, 0.060 inch (0.152 cm), 0.044 inch (0.112 cm) and 0.005 inch (0.013 cm). The polymer feed intrinsic viscosity was 0.95. The yarn was then draw wound at a draw ratio of 5.09 over a heated plate at 150° C. between heated rolls and taken up at 1120 ft/min (5.7 m/s) to produce a yarn having the following characteristics: denier 1091; U.T.S. (gpd) 6.21; B.S. (lbs) 14.9; U.E. (%) 19.4; and percent hollow—20.

For comparison sake, a solid filament yarn is produced in accordance with this example; strength translational efficiencies for the hollow filament yarn are superior to the solid filament yarn.

TABLE 4

| Property | Control | 17% Hollow | 5% Hollow |
|---|---|---|---|
| Yarn Strength | 100 | 98 | 103 |
| Greige Strength | 100 | 97 | 99 |
| Dip Strength | 100 | 118 | 116 |
| Translational Efficiency** | 80% | 97% | 90% |
| Cure Strength | 100 | 100 | 108 |
| Flex Strength | 100 | 102 | 107 |
| Heat Resistance | 100 | 96 | 99 |
| Heat Degradation A | 100 | 94 | 95 |
| Heat Degradation B | 100 | 107 | 105 |
| Static A | 100 | 100 | 95 |
| Static B | 100 | 100 | 100 |
| U Adhesion | 100 | 97 | 103 |
| Aged U Adhesion | 100 | 110 | 107 |
| Dynamic | | | |
| -Static | 100 | 113 | 113 |
| -Dynamic | 100 | 92 | 108 |
| Mallory | 100 | 178 | 227 |

**cord construction was 2 ends 840 denier, 12 × 12.

We claim:

1. A yarn containing a plurality of synthetic polymer filaments, said filaments each having a continuous void throughout its length and an outside diameter ranging from 0.02 to 0.20 mm, said yarn having a filament to yarn strength translation efficiency of at least 98 percent, a drawn denier of 250 to 1500, a tenacity of a least 6.0 gram per denier, and a density of less than one, wherein the cross-sectional area of the void is 3 to 50 percent of the cross-sectional area bounded by the perimeter of the filament.

2. The yarn of claim 1 wherein the synthetic polymer is nylon.

3. The yarn of claim 2 wherein the synthetic polymer is nylon 6.

4. The yarn of claim 1 wherein the synthetic polymer is polyester.

5. The yarn of claim 4 wherein the synthetic polymer is polyethylene terephthalate.

6. The yarn of claim 1 having a drawn denier of 850 to 1000, a tenacity of 6.0 to 9.5 gpd, and wherein the filament has an outside diameter ranging from 0.025 to 0.15 mm, the cross-sectional area of the void is 3 to 30 percent of the cross-sectional area bounded by the perimeter of the filament, and the synthetic polymer is nylon 6.

7. The yarn of claim 6 wherein the cross-sectional area of the void is 5 to 17 percent of the cross-sectional area bounded by the perimeter of the filament.

8. A yarn containing a plurality of synthetic polymer filaments each having a continuous void throughout its length and an outside diameter ranging from 0.02 to 0.20 mm, said yarn having a yarn to cord strength translation efficiency of at least 90 percent, a drawn denier of 250 to 1500, a tenacity of at least 6.0 gram per denier, and a density of less than one, wherein the cross-sectional area of the void is 3 to 50 percent of the cross-sectional area bounded by the perimeter of the filament.

9. The yarn of claim 8 wherein the synthetic polymer is nylon.

10. The yarn of claim 9 wherein the synthetic polymer is nylon 6.

11. The yarn of claim 8 wherein the synthetic polymer is polyester.

12. The yarn of claim 11 wherein the synthetic polymer is polyethylene terephthalate.

13. The yarn of claim 8 having a drawn denier of 850 to 1000 and a tenacity of 6.0 to 9.5 gpd, and wherein the cross-sectional area of the void is 3 to 30 percent of the cross-sectional area bounded by the perimeter of the filament, the filament has an outside diameter ranging from 0.025 to 0.15 mm, and the synthetic polymer is nylon 6.

14. The yarn of claim 13 wherein the cross-sectional area of the void is 5 to 17 percent of the cross-sectional area bounded by the perimeter of the filament.

* * * * *